United States Patent [19]

Berry

[11] Patent Number: 5,067,399

[45] Date of Patent: Nov. 26, 1991

[54] WIRE MARKING APPARATUS FOR MARKING SELECTED CODES ONTO ANY OF A PLURALITY OF WIRES

[75] Inventor: Stephen R. Berry, Naperville, Ill.

[73] Assignee: Molex Incorporated, Lisle, Ill.

[21] Appl. No.: 511,685

[22] Filed: Apr. 20, 1990

[51] Int. Cl.[5] ..... B41F 17/10

[52] U.S. Cl. ..... 101/11; 101/21; 101/27

[58] Field of Search ..... 101/9, 11, 21, 27, 35, 101/43, 44

[56] References Cited

U.S. PATENT DOCUMENTS

| | | | |
|---|---|---|---|
| 2,356,951 | 8/1944 | Runton | 101/27 X |
| 2,909,990 | 10/1959 | Judisch | 101/9 X |
| 3,031,951 | 5/1962 | Campbell | 101/44 X |
| 3,537,392 | 11/1970 | Ikuss | 101/27 X |
| 3,726,212 | 4/1973 | Combs | 101/21 |
| 4,370,542 | 1/1983 | Mills et al. | 101/35 X |
| 4,398,457 | 8/1983 | Takahashi et al. | 101/44 |
| 4,416,199 | 11/1983 | Davison | 101/27 X |

OTHER PUBLICATIONS

Artos Engineering Co. Brochure, WM-100 Hot Stamp Wire Marking Device.

Eubanks Engineering Co. Brochure, Model 77600 AutoTab Hot Stamp Wire Marker.

Komax Corporation Brochure, Komax 25 Programmable Hot Stamp Marker.

*Primary Examiner*—Clifford D. Crowder

*Attorney, Agent, or Firm*—Louis A. Hecht; Stephen Z. Weiss; Charles S. Cohen

[57] ABSTRACT

A wire marking apparatus for marking selected codes onto any of a plurality of wires. The marking apparatus may be disposed between a source of a plurality of wires and an apparatus for processing the wires. The marking apparatus includes a support and marking assembly that is movable in directions extending parallel to the wires and a marking head that is movable in directions orthogonal to the wire. These orthogonal movements are carried out to properly position the marker with the appropriate wire to be marked and at a selected location along the wire.

23 Claims, 4 Drawing Sheets

WIRE MARKING APPARATUS FOR MARKING SELECTED CODES ONTO ANY OF A PLURALITY OF WIRES

BACKGROUND OF THE INVENTION

Electrical devices comprise insulated wires extending from one electrical component in the device to another. Each insulated wire is cut to a selected length and the conductor within the insulated wire is electrically connected to a terminal. The preparation of each wire typically includes pulling a selected length of the wire from a spool or reel, removing kinks or bends from the wire, cutting the wire at the specified length and appropriately preparing the opposed cut ends for termination. The preparation of the wire ends may include stripping a selected length of insulation from the wire to expose the portion of the conductor to be terminated.

Wires incorporated into an electrical apparatus may be of various gauges, conductivities and lengths. To ensure that each wire is installed in its proper location within the electrical apparatus and to facilitate subsequent repair or rewiring, it is common to provide wires with different colors of insulation and with identifying indicia on each wire. The identifying indicia preferably is disposed at one or more preselected locations on the wire, such as in proximity to the terminals. The identifying indicia may be provided in the form of a separate collar, tape or the like. Although identifying means such as these are effective, they generally are costly and time-consuming to apply. Even small cost or time penalties can be significant in the highly competitive electronics industry.

Other wire identifying indicia can be provided by marking the insulation of the wire. The marking can be provided by known hot stamping means to put a substantially indelible marking on a selected portion of the insulation. Hot stamping generally can be carried out as part of the wire preparation process for single insulated wires of constant length. In particular, a known hot stamping apparatus can be disposed in a selected spaced relationship to a wire cutting and stripping means to stamp identifying indicia a selected distance from the cut ends of each wire. Thus, hot stamping can be carried out economically within the normal wire processing cycle of the apparatus described above for preparing and terminating individual insulated wires of the same length.

The prior art hot stamping apparatus for wires is known to include a hot stamping head having means for stamping a selected code from a plurality of optional codes. The known apparatus has a maximum of twelve optional codes from which one code is selected. The changing of codes typically requires manual indexing of code wheels on the stamping head. Thus, a plurality of wires of a first code will be marked. The entire assembly of the wire marking apparatus and wire processing apparatus will then be stopped to enable indexing of the code wheel to a new code for marking on a second plurality of wires by the prior art apparatus.

The indelible material applied to the wire is delivered to the stamping head on a tape. The tape will carry an indelible marking material of a color that is selected in accordance with the wire being marked. For example, a dark color wire will require a light color code, while a light color wire will require a darker code. The changing of wires being processed and marked may also require the changing of marking tapes in the prior art apparatus.

Electrical devices generally are not limited to a complex array of individual wires. In the more typical instance, the wires define portions of harness assemblies wherein a plurality of generally parallel wires extend between at least a pair of multi-terminal connectors. The prior art wire marking apparatus would require the individual and sequential marking of the prepared and terminated wires for subsequent insertion into the multi-terminal connectors of the harness assembly. This has been a fairly slow process with the wire marking cycle times being slower than the cycle times for the harness assembly equipment. The use of prior art wire marking equipment is complicated even more if different color wire markings are required in view of the different color wire insulations employed. Further complications are presented if the wires in a particular harness assembly are not all of the same length. The requirement for different lengths of wire would require changes to the prior art wire stamping equipment that would substantially interrupt the normal cycle times.

In view of the above, it is an object of the subject invention to provide a wire marking apparatus for efficiently placing identifying indicia onto wires.

Another object of the subject invention is to provide a wire marking apparatus for readily accommodating wires of different respective lengths.

An additional object of the subject invention is to provide a wire marking apparatus that can place any of a plurality of codes onto the wires.

A further object of the subject invention is to provide a wire marking apparatus that can selectively stamp an appropriate wire identifying indicia onto any of a plurality of wires in a color selected in accordance with the color of the wire insulation.

Still a further object of the subject invention is to provide a wire marking apparatus that can be programmed for automatically marking wires with identifying indicia as part of the normal cycle time for a wire processing in a multi-wire harness assembly apparatus.

SUMMARY OF THE INVENTION

The subject invention is directed to an apparatus for placing identifying indicia on wires. More particularly, the apparatus may be used with wire processing means, and may be operative to place indicia on wires as the wires are being cut, stripped and/or terminated by the processing means. Preferably, the wire marking apparatus is timed to work within the normal cycle time of the wire processing means.

The apparatus may be operative to place indicia on a single wire being processed or on each of a plurality of wires for incorporation into a wire harness assembly. The number of wires being marked by the apparatus is variable in accordance with the day-to-day changing needs of the wire processing and harness assembling systems. A typical embodiment of the apparatus is operative to accommodate up to twelve wires, but can readily be adjusted to accommodate sixteen or more wires in accordance with the needs of the system The placement of indicia on the wires may be by any of several known marking means for placing a substantially indelible indicia on the insulation of the wire. A preferred wire marking means comprises hot stamping means wherein a transfer tape is employed to transport a selected indelible marking from a reel into a hot stamping head. The hot stamping head of the subject invention may include a plurality of die means selectively mountable and/or removable from the head, with each die means carrying a selected wire code and being disposed at a specific location or address within the stamp head. The head further includes electrical heater means for heating the die means, such that the heat and pressure applied by the die means is operative to transfer the indelible marking from the tape to the insulation of the wire to be marked. The particular die means and wire code to be applied to the wire insulation can be varied from one wire to the next between successive actuations of the stamp head.

The apparatus further includes means for delivering a plurality of different transfer tapes to the stamp head for enabling the application of different color codes to the respective wires. The particular color code is selected in accordance with the color of wire being processed. In this regard, wires having a light color insulation will generally be provided with a dark colored code imprinted thereon, while wires having a dark color insulation will be provided with a light color code imprinted thereon. The dark color tape may be aligned with only selected die means while the light color tape is aligned with only the other die means.

The wire marking apparatus of the subject invention further includes means for supporting a plurality of wires in a generally parallel array, with the length of wires defining an X-axis direction and with the spacing between wires defining a Y-axis direction. The support means may include anvils which may be disposed directly beneath the respective wires and in line with the stamp head. The apparatus further includes means for moving the stamp head in a Y-axis direction for selecting particular wires to be stamped and for moving the stamp head and anvils in an X-axis direction for the placement of the stamped indicia on a wire at a specified longitudinal location. In this manner, the apparatus is operative to print any of a plurality of different codes in any of a plurality of different colors at a selected longitudinal or X-axis position on any of a plurality of different wires spaced from one another in a Y-axis direction.

The movement of the print head and the anvils or other necessary supporting structures in the X-axis or longitudinal direction conceivably can create pulling or pushing forces on at least selected wires being processed. These forces can cause excess wire to be pulled off supply spools or can advance excess wire toward subsequent wire processing or termination means. The slack wire created by these pulling or pushing forces can cause interference between adjacent wires, and can cause inaccuracies with regard to the lengths of wires and the longitudinal positioning of wire codes on selected wires. Accordingly, the apparatus may further include at least one clamp means for clamping selected wires. Preferably, the apparatus includes a pair of spaced apart clamp means with the stamp head being disposed intermediate the spaced clamp means. The distance between the clamp means preferably is selected to equal or exceed the maximum range of X-axis or longitudinal movement that may be required for the stamp head. More particularly, this distance may be a function of the maximum anticipated difference in length between wires to be processed. The clamp means may be operative to release selected wires to permit longitudinal advancement while other wires in the array remain clamped.

The apparatus of the subject invention further includes control means for receiving and storing instructions as to the location or address for each code in the stamp head and the corresponding Y-axis locations and the relative longitudinal or X-axis locations at which codes are to be applied. The X-axis locations for the application of codes is determined by the specified lengths for wires in a harness assembly. The control means is further operative to generate signals for operating the apparatus, including signals for moving the stamp head in specified X-axis and/or Y-axis directions, and for moving the stamp head or anvils in Z-axis directions for placing the markings on the wires. The control means may be operatively connected to other wire processing means, such as means for cutting a wire to a specified length, trimming a wire end and/or stripping insulation from a wire. In particular, the control means for the wire marking apparatus is operative to print a selected code in a specified color and at a specified location on a wire that has temporarily stopped its longitudinal movement for other wire processing steps. In this manner, the printing of the code will not interfere with the normal cycle time for processing wires.

DETAILED DESCRIPTION OF THE PREFERRED EMBODIMENT

Figure 1:
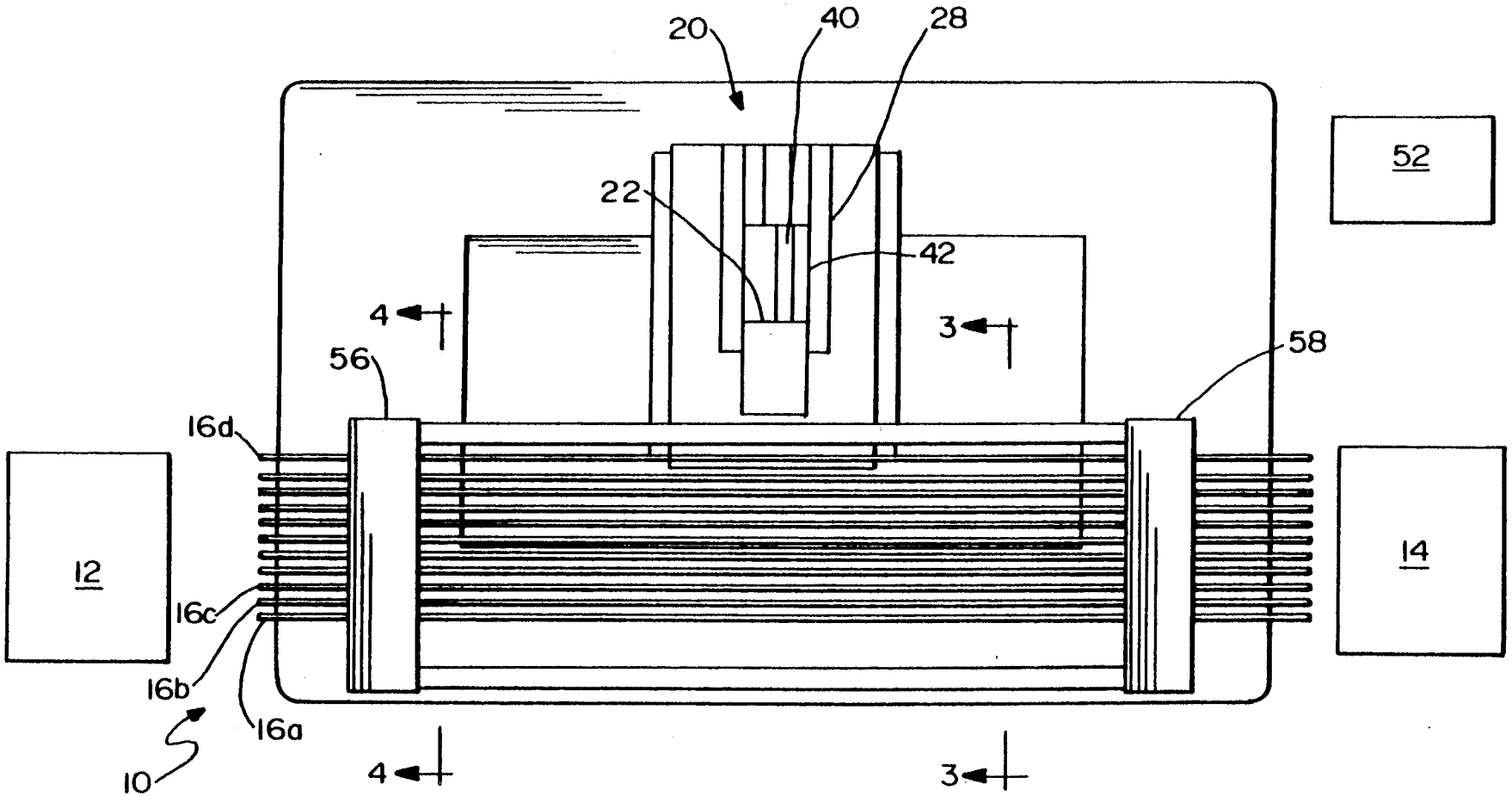
FIG. 1 is a top plan view of a wire marking apparatus in accordance with the subject invention.

The wire marking apparatus of the subject invention is identified generally by the numeral 10 in FIGS. 1-4. The apparatus 10 is disposed intermediate a source of wires identified generally by the numeral 12 and a wire processor identified generally by the numeral 14. It is to be understood that the source of wires 12 and the wire processor 14 can take any of a great many forms. The typical source of wires 12 will comprise a plurality of spools of wires for incorporation into a wire harness. The spools may be oriented to facilitate the unwinding of wires therefrom in response to forces generated by the wire processor 14. The source of wires 12 may further include appropriate known means for ensuring the removal of kinks and other such wire discontinuities prior to the longitudinal advancement of the wires toward the wire marking apparatus 10 of the subject invention and the wire processor 14. The wire processor 14 typically will include means for feeding individual wires longitudinally, cutting wires to specified lengths and trimming insulation from the cut ends of the wires. The wires may then advance to further processing steps for termination and for insertion into the housings of a harness assembly.

For reference throughout the remainder of this application, the longitudinal direction of movement of the wires is identified as the X-axis. The Y-axis is shown in FIG. 1 and defines a generally horizontally aligned axis extending transverse to the longitudinal direction of movement of the wires. The Z-axis is identified in FIG. 2 and defines a substantially vertical axis extending transverse to the longitudinal direction of the wires. It is to be understood that the respective axes are identified for reference purposes only and do not necessarily imply a required gravitational orientation of the apparatus 10.

The apparatus 10 is operative to place selected wire marking codes onto each of a plurality of wires which are identified generally by the numerals 16*a*–16*d*. Although only four wires are specifically identified in the Figures, it is to be understood that the typical apparatus 10 may be operative to individually mark at least twelve different wires, and in some embodiments sixteen or more wires.

The apparatus 10 includes a hot stamp assembly which is identified generally by the numeral 20. The hot stamp assembly 20 incudes a stamp head 22 and an anvil assembly 24. The hot stamp assembly 20 is mounted to a track 26 which extends generally parallel to the X-axis. Thus, the entire hot stamp assembly 20 is movable in an X-axis direction along the track 26. The movement of the hot stamp assembly 20 in an X-axis direction is carried out in accordance with the length of the particular wire 16*a–d* being processed by the processor 14 and being marked by the apparatus 10. As noted above, harness assemblies often will include a plurality of different length wires. Thus, the entire hot stamp assembly 20 may periodically move in X-axis directions between each wire marking as explained herein. The magnitude of the maximum X-axis movement that is possible for the hot stamp assembly 20 will depend upon the length of the track 26, and is selected to reflect the maximum range of differences in wire lengths that are anticipated for the harness assemblies being processed.

The hot stamp head 22 of the hot stamp assembly 20 is mounted to a gantry support 28 which extends in a generally Y-axis direction. The hot stamp head 22 is movable along the gantry support 28 to align selected portions of the hot stamp head 22 with selected wires 16*a–d*. The Y-axis movement of the hot stamp head 22 relative to the support gantry 28 is not dependent upon any particular movement of the entire hot stamp assembly 20 along the track 26. Thus, the Y-axis movement of the hot stamp head 22 can be carried out simultaneously with the X-axis movement of the entire hot stamp assembly 20. Thus, the hot stamp head may actually be subjected to a diagonal movement in the X-Y plane in view of the simultaneous X-axis movement of the entire hot stamp assembly 20 and the Y-axis movement of the hot stamp head 22 within the assembly 20.

The hot stamp head 22 includes trailing and leading hot stamp markers 30 and 32 respectively. The trailing hot stamp marker 30 is operative to place a selected code at a location on a wire 16*a–d* that will correspond to the trailing end of a first wire, while the leading hot stamp marker 32 will simultaneously mark the selected wire 16*a–d* at a location thereon that will define the leading end of a second wire being processed by the wire processor 14.

The respective trailing and leading hot stamp markers 30 and 32 may be substantially identical to one another. More particularly, with reference to FIGS. 2 and 3, the trailing hot stamp marker 30 includes first and second linear arrays 34 and 36 of die subsets 38*a–d*. Each die subset 38*a–d* in the parallel arrays 34 and 36 corresponds to a particular code to be marked onto a corresponding wire 16*a–d*. The subsets 38*a–d* in the arrays 34 and 36 correspond in total number to the number of wires 16*a–d*. Additionally, each subset 38*a–d* will have a specified and unique Y-axis position or address in the trailing hot stamp marker 30.

The trailing hot stamp marker 30 further includes light and dark marker tapes 40 and 42 respectively. The light tape 40 is aligned with the array 34 of die subsets while the dark tape 42 is aligned with the array 36. The disposition of the respective die subsets 38*a–d* in the arrays 34 and 36 is selected in accordance with the color of insulation on the corresponding wires 16*a–d*. Thus, the die subset 38*a* is depicted being in line with the light colored marking tape 40 because, in this example, the wire 16*a* has a dark colored insulation which would require a light colored marking code for sufficient legibility. Similarly, the die subset 38*d* is aligned with the dark tape 42 because, in this instance, the wire 16*d* has a light colored insulation which requires a dark colored marking code for acceptable legibility. A similar or identical arrangement of die subsets and marker tapes is provided in the leading hot stamp marker 32.

Figure 3:
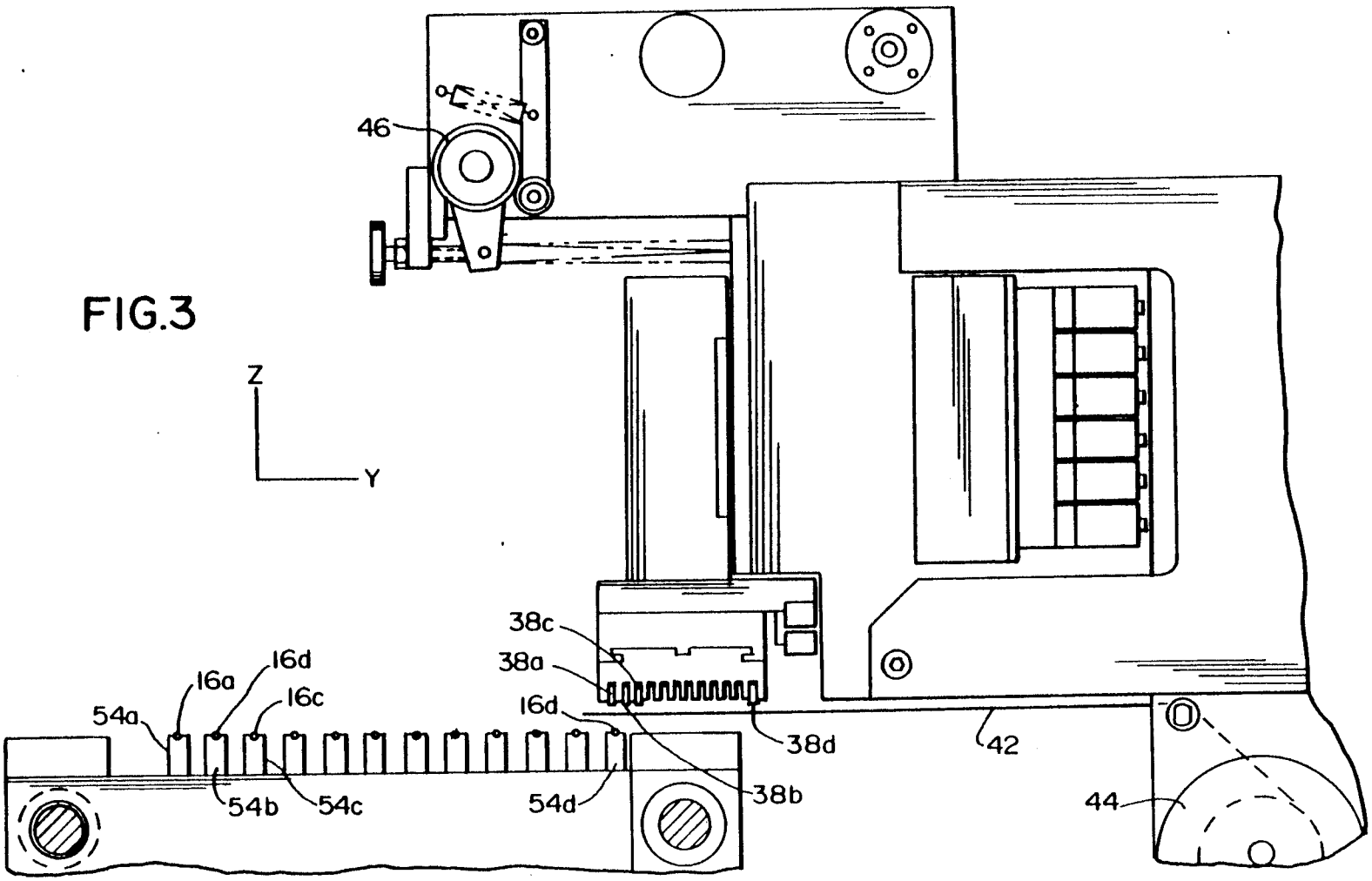
FIG. 3 is a cross-sectional view taken along line 3—3 in FIG. 1.

The marker tapes 40 and 42 are mounted on respective feed reels 44 and extend to take-up reels 46 as shown in FIG. 3. The tapes 40 and 42 are periodically advanced to ensure clear marking of the codes onto the wires 16*a–d*.

The spacing between the respective die subsets 38*a–d* in the hot stamp marker 30, 32 is less than the center-to-center spacing between the wires 16*a–d*. Thus, the respective die subsets 38*a–d* are not continuously aligned with their corresponding wire 16*a–d*. Rather, it is necessary for the entire hot stamp head 22 to move a specified distance in a Y-axis direction to align the appropriate die subset 38*a–d* with the corresponding wire 16*a–d*. These Y-axis movements of the hot stamp head 22 are controlled by controller 52 which is programmed with information specifying the Y-axis location for each code and the corresponding Y-axis location for each wire.

Figure 2:
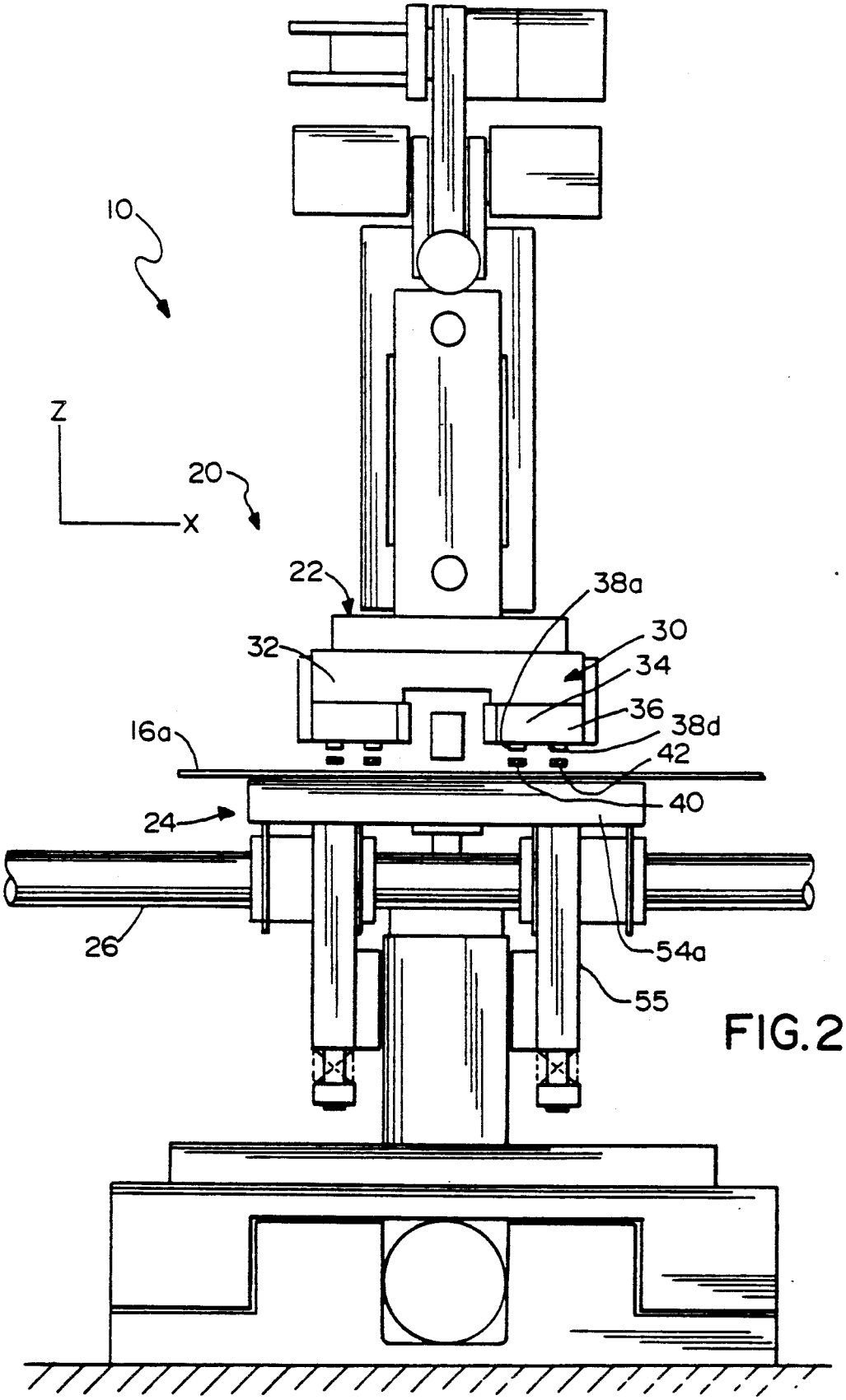
FIG. 2 is a front elevational view of the wire marking apparatus shown in FIG. 1.

The anvil assembly 24, as shown in FIGS. 2 and 3, comprises a plurality of anvils 54*a–d* which are spaced from one another for alignment with the corresponding wire 16*a–d*. The anvils are selectively movable in a Z-axis direction by pistons 55 toward and away from the hot stamp head 22. The range of movement of each anvil 54*a–d* is sufficient to urge the corresponding wire 16*a–d* upwardly in a Z-axis direction and into contact with the corresponding die subset 38*a–d*. More particularly, the range of movement of each anvil 54*a–d may be limited to only about* 0.25 inch.

Figure 4:
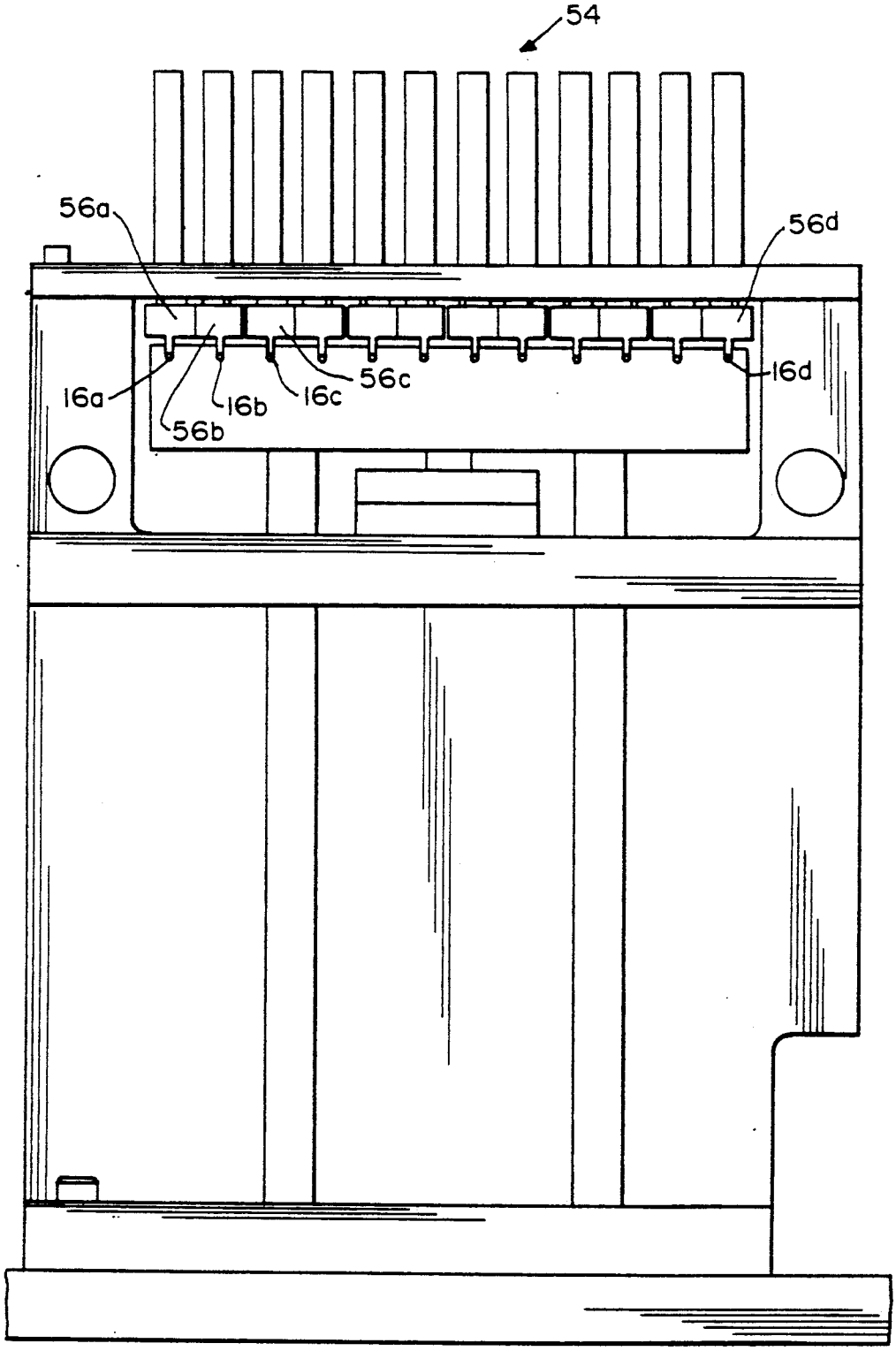
FIG. 4 is a cross-sectional view taken along line 4—4 in FIG. 1.

The wire marking assembly 10 further includes wire clamp assemblies 56 and 58 as shown in FIGS. 1 and 4. The wire clamp assemblies 56 and 58 are spaced from one another in an X-axis direction and are disposed on opposite respective sides of the hot stamp assembly 20. The clamp assemblies 56 and 58 each include an array of independently activatable wire clamps aligned with and selectively engageable with the respective wires 16*a–d*. In particular, with reference to FIG. 4, the clamp assembly 56 includes separate wire clamps 56*a–d* which are aligned with the respective wires 16*a–d*.

In operation, the wires 16*a–d* are sequentially advanced controlled and programmed amounts by the wire processor 14 which pulls individual wires 16*a–d* from the wire source 12 and through the wire marking apparatus 10. The required length of each wire 16*a–d* may vary from one wire to the next. Accordingly, depending upon the particular wires 16*a–d* being processed, the hot stamp assembly 22 of the apparatus 10 will move in an X-axis direction along the rail 26 to align itself generally centrally over the next sequential cut in the corresponding wire 16*a–d* to be effected by the wire processor 14. To ensure that the movement of the anvils 24 and the hot stamp head 22 do not inadvertently pull any wires 16*a–d*, the clamp assemblies 56 and 58 are actuated by the control means 52 to clamp all of the wires 16*a–d* except for the particular wire being processed by the wire processor 14. In this regard, the hot stamp assembly will be moving in the X-axis direction while the particular wire being processed 16*a–d* is being advanced by the processor.

Simultaneously with the X-axis movement of the entire hot stamp assembly 20, the hot stamp head 22 is moved in a Y-axis direction along the support gantry 28 to align the appropriate die subset 38*a–d* with the particular wire 16*a–d* being processed. The simultaneous X-axis movement of the entire hot stamp assembly 20 and the Y-axis movement of the hot stamp head 22 will effectively generate diagonal movements of the hot stamp head 22 relative to the array of wires 16*a–d* being processed. Once the proper X-axis and Y-axis positions have been achieved for the relevant die subsets 38*a–d*, the particular anvil in the anvil assembly 24 is moved upwardly in a Z-axis direction to urge the corresponding wire 16*a–d* upwardly and into the tape 40, 42 and the appropriate die subset 38*a–d*. The die subset 38*a–d* may be heated in the known manner to generate the transfer of the marking medium from the tape 40 onto the wire. As shown most clearly in FIG. 2, this marking procedure will simultaneously generate spaced apart trailing and leading markings on the wire 16*a–d* being processed.

After the marking has been completed, the anvils will move downwardly in a Z-axis direction to permit further movement of the corresponding wires 16*a–d* toward the processor 14 which will subsequently cut the wire centrally between the markings placed thereon for further processing as explained above.

The wire marking will proceed by clamping the wire previously processed and marked and releasing the next wire to be processed. The hot stamp assembly will then move in an X-axis direction while the hot stamp head thereof will move in a Y-axis direction to properly align the appropriate die subset 38*a–d* with the next wire 16*a–d* to be marked.

While the invention has been described with respect to a preferred embodiment, it is apparent that various changes can be made without departing from the scope of the invention as defined by the appended claims. In particular, the structure disclosed herein can be adapted or any number of wires, any number of codes and any number of colors. Additionally, the apparatus is not limited to hot stamping technology, but may include other marking techniques for placing an appropriate code at selected locations on the wire.

I claim:

1. A wire marking apparatus for use with a supply of wire and a wire processing means for drawing wire from the supply, said wire marking apparatus including a marking head for marking a selected code onto the wire and an anvil for supporting the wire while marking the code thereon, wherein the improvement comprises:

support means for supporting a plurality of wires to be marked in a parallel array, each wire to be marked being aligned with an anvil means;

longitudinal positioning means for moving the marking apparatus in a direction extending generally parallel to the wires;

wire selection means for moving at least a portion of the wire marking apparatus in a direction extending generally orthogonal to axes of the wires for positioning a selected portion of the wire marking apparatus relative to a selected wire to be marked; and moving means for moving each said wire to be marked relatively toward and into engagement with said marking head to place a selected code thereon.

2. A wire marking apparatus as in claim 1 wherein the marking apparatus comprises a plurality of marking means incorporated therein for marking any of a selected plurality of codes onto any of the wires.

3. A marking apparatus as in claim 2 further comprising first and second color marking means for selectively applying codes of first and second colors to the wires.

4. A marking apparatus as in claim 1 wherein the marking means comprises first and second arrays of dies for marking selected codes on the wires, said marking means further comprising first and second marker tapes aligned respectively with the first and second arrays of codes, the first tape comprising marking means of a first color, and the second tape comprising marking means of a second color, whereby a marking color is selected in accordance with the color of insulation on the wire being marked.

5. A marking apparatus as in claim 1 wherein said wire moving means comprises means for moving each said anvil means independently toward the associated wire for urging the wire into the marking head for placing a selected code thereon.

6. A wire marking apparatus as in claim 1 wherein the support means further comprises a pair of spaced apart clamp assemblies for clamping at least selected wires in the array.

7. A wire marking apparatus as in claim 6 wherein each said clamp assembly comprises a plurality of clamp means for independently and selectively clamping and releasing each said wire in the array of wires.

8. A wire marking apparatus as in claim 6 wherein the support means further comprises means for permitting longitudinal movement of a selected one of said wires being processed by the wire processor and means for clamping the remaining wires.

9. A wire marking apparatus for stamping codes onto a plurality of wires, said wire marking apparatus being disposed intermediate a supply of said wire and a wire processor for selectively feeding said wires from the supply and through the wire marking apparatus, the wire marking apparatus comprising a support and a stamp head for placing a selected code on a wire being processed, wherein the improvement comprises:

first and second spaced apart clamp assemblies for selectively and independently clamping each wire and for maintaining the wires in a substantially parallel array;

track means extending generally parallel to the wire and disposed intermediate the wire clamp means;

a stamp assembly movable along the track means parallel to the wire and between the clamp means, said stamp assembly comprising said stamp head and anvil means for supporting said wires, the stamp head comprising a plurality of die subsets, each being selectively alignable with each of said wires, whereby movement of the stamp assembly along the track means aligns the desired die subset at a selected location along the wire to be marked, and said stamp head being movable relative to said anvil means in directions generally perpendicular to the wires for aligning a selected one of said die subsets with said wire being marked.

10. A wire marking apparatus as in claim 9 wherein the stamp head is selectively movable in a direction extending substantially orthogonal to the wires for aligning a selected one of said die subsets with one of said wires to be marked.

11. A wire marking apparatus as in claim 9 further comprising first and second marker tapes for delivering first and second marking materials of different colors to selected ones of said wires, said first marker tape being aligned with at least one of said die subsets, and the second marker tape being aligned with at least one other die subset.

12. A wire marking apparatus for placing codes onto each wire of an array of parallel wires, said apparatus being disposed intermediate a supply of said wires and a wire processor for selectively feeding said wires from said supply and through the wire marking apparatus, said apparatus comprising:

support means for supporting said array of wires;

marking means for placing a selected code onto a wire being processed, said marking means having first and second marking heads, each permitting selective marking of the wires with a code of a different color;

wire selection means for moving at least a portion of said marking means relative to said wires in a direction generally perpendicular to the axes of the wires for positioning a selected portion of the marking means relative to a selected wire to be marked; and moving means for moving each said selected wire relatively toward and into engagement with said marking means to place a predetermined code thereon by said first and second marking heads.

13. A wire marking apparatus as in claim 12 further comprising two of said marking means aligned for marking two codes of the same color on said selected wire, said marking means being spaced apart so that said codes are marked at spaced locations along the axis of the wire, whereby said wire can be subsequently severed between said codes.

14. A wire marking apparatus as in claim 13 further comprising clamp means for independently and selectively clamping and releasing each said wire in the array of wires.

15. A wire marking apparatus as in claim 14 further comprising longitudinal positioning means for moving both marking means in a direction generally parallel to the wires.

16. A wire marking apparatus as in claim 12 further comprising longitudinal positioning means for moving both marking means in a direction generally parallel to the wires.

17. A wire marking apparatus as in claim 12 wherein said marking means comprises:

a hot stamp head having first and second arrays of die subsets, with each die subset comprising means for placing a selected code on one of said wires; and first and second marker tapes, said first marker tape being aligned with the first array of die subsets and the second marker tape being aligned with the second array of die subsets, whereby the first and second marker tapes and first and second arrays of dies subsets enable selective marking of the wires with codes of two different colors.

18. A wire marking apparatus as in claim 17 further comprising means for moving the die subsets in directions extending generally orthogonal to the wires.

19. A wire marking apparatus as in claim 18 further comprising means for moving the die subsets and said marker tapes in directions extending generally parallel to the wires.

20. A wire marking apparatus for placing codes onto a wire, said apparatus being disposed intermediate a supply of said wire and a wire apparatus for selectively feeding said wire from said supply and through the wire marking apparatus, said apparatus comprising:

support means for supporting said wire;

first and second marking means, each for placing a selected code on said wire, said first and second marking means being spaced apart along an axis parallel to that of said wire so that a first code marked by said first marking means is spaced from a second code marked by said second marking means along the axis of the wire, whereby said wire can be subsequently severed between said codes;

said first and second marking means each comprising first and second marking heads, each said marking head having a plurality of die subsets, each being selectively alignable with said wire, a pair of marker tapes of different colors associated with each said marking means, each of said first marking heads of said first and second marking means being operatively associated with marker tape of one color and each of said second marking heads of said first and second marking means being operatively associated with marker tape of a second color.

21. A wire marking apparatus as in claim 20 further comprising means for moving said marking head in a direction generally perpendicular to the axis of the wire for positioning a selected portion of the each marking means relative to the wire.

22. A wire marking apparatus as in claim 21 further comprising longitudinal positioning means for moving both marking means in a direction generally parallel to the wire.

23. A wire marking apparatus as in claim 20 further comprising longitudinal positioning means for moving both marking means in a direction generally parallel to the wire.

* * * * *